US008978767B2

(12) United States Patent
Machin et al.

(10) Patent No.: US 8,978,767 B2
(45) Date of Patent: Mar. 17, 2015

(54) SUBSEA WELL INTERVENTION LUBRICATOR AND METHOD FOR SUBSEA PUMPING

(75) Inventors: Jonathan Machin, Gallop Gables (SG); Peter Nellessen, Missouri City, TX (US)

(73) Assignee: OneSubsea, LLC, Houston, TX (US)

( * ) Notice: Subject to any disclaimer, the term of this patent is extended or adjusted under 35 U.S.C. 154(b) by 788 days.

(21) Appl. No.: 13/058,743

(22) PCT Filed: Aug. 19, 2009

(86) PCT No.: PCT/IB2009/053665

§ 371 (c)(1), (2), (4) Date: Apr. 26, 2011

(87) PCT Pub. No.: WO2010/020956

PCT Pub. Date: Feb. 25, 2010

(65) Prior Publication Data

US 2011/0192610 A1 Aug. 11, 2011

Related U.S. Application Data

(60) Provisional application No. 61/136,219, filed on Aug. 19, 2008.

(51) Int. Cl.

| | |
|---|---|
| ***E21B 17/01*** | (2006.01) |
| ***F04D 13/10*** | (2006.01) |
| ***E21B 33/068*** | (2006.01) |
| ***E21B 33/076*** | (2006.01) |

(52) U.S. Cl.

CPC ..... *F04D 13/10* (2013.01); *E21B 33/068* (2013.01); *E21B 33/076* (2013.01)

USPC ..... 166/338; 166/351; 166/352; 166/368

(58) Field of Classification Search

USPC ..... 166/338, 339, 351, 352, 357, 368, 311, 166/312, 77.1, 90.1, 241.5; 137/15.01, 15, 137/5

See application file for complete search history.

(56) References Cited

U.S. PATENT DOCUMENTS

| | | | | |
|---|---|---|---|---|
| 3,500,907 | A * | 3/1970 | Gentry | 166/70 |
| 4,193,307 | A * | 3/1980 | Baker et al. | 73/701 |
| 4,506,735 | A * | 3/1985 | Chaudot | 166/357 |

(Continued)

FOREIGN PATENT DOCUMENTS

| | | |
|---|---|---|
| WO | 02/084160 | 10/2002 |
| WO | 2006/003362 | 1/2006 |

(Continued)

OTHER PUBLICATIONS

International search report for the equivalent PCT patent application No. PCT/IB2009/053665 issued on Apr. 26, 2010.

(Continued)

*Primary Examiner* — Matthew Buck
*Assistant Examiner* — Aaron Lembo
(74) *Attorney, Agent, or Firm* — Chamberlain Hrdlicka

(57) ABSTRACT

A subsea well service system and method are presented for use with an subsea pump capable of flushing the well intervention lubricator of an underwater hydrocarbons production facility. The system essentially includes at least one pump placed at a subsea location in proximity to the well intervention lubricator, and at least one fluid reservoir connected to the pump.

12 Claims, 2 Drawing Sheets

(56) References Cited

U.S. PATENT DOCUMENTS

| | | | | |
|---|---|---|---|---|
| 4,527,632 | A * | 7/1985 | Chaudot | 166/357 |
| 6,129,150 | A * | 10/2000 | Lima | 166/357 |
| 6,216,799 | B1 * | 4/2001 | Gonzalez | 175/5 |
| 6,263,981 | B1 * | 7/2001 | Gonzalez | 175/5 |
| 6,276,455 | B1 * | 8/2001 | Gonzalez | 166/357 |
| 6,325,159 | B1 * | 12/2001 | Peterman et al. | 175/7 |
| 6,359,778 | B1 | 3/2002 | Wu | |
| 6,415,877 | B1 * | 7/2002 | Fincher et al. | 175/5 |
| 6,651,745 | B1 * | 11/2003 | Lush et al. | 166/357 |
| 6,893,486 | B2 * | 5/2005 | Sanderford et al. | 95/243 |
| 6,907,933 | B2 * | 6/2005 | Choi et al. | 166/357 |
| 7,178,592 | B2 * | 2/2007 | Chitty et al. | 166/267 |
| 7,210,530 | B2 * | 5/2007 | Lush et al | 166/357 |
| 7,219,737 | B2 * | 5/2007 | Kelly et al. | 166/339 |
| 7,270,185 | B2 * | 9/2007 | Fontana et al. | 166/358 |
| 7,762,357 | B2 * | 7/2010 | deBoer | 175/66 |
| 7,914,266 | B2 * | 3/2011 | Kerr et al. | 417/410.1 |
| 7,938,190 | B2 * | 5/2011 | Talamo et al. | 166/358 |
| 7,992,654 | B2 * | 8/2011 | deBoer | 175/66 |
| 7,992,655 | B2 * | 8/2011 | deBoer | 175/70 |
| 8,113,291 | B2 * | 2/2012 | Bailey et al. | 166/379 |
| 8,136,600 | B2 * | 3/2012 | Fowler et al. | 166/357 |
| 8,162,063 | B2 * | 4/2012 | Humphreys | 166/358 |
| 8,322,434 | B2 * | 12/2012 | Fielding et al. | 166/357 |
| 8,322,460 | B2 * | 12/2012 | Horton et al. | 175/5 |
| 8,342,248 | B2 * | 1/2013 | Hall et al. | 166/344 |
| 2011/0011593 | A1 * | 1/2011 | Borhaug et al. | 166/311 |
| 2011/0094749 | A1 * | 4/2011 | Richards et al. | 166/345 |
| 2011/0247828 | A1 * | 10/2011 | Patel et al. | 166/348 |

FOREIGN PATENT DOCUMENTS

| | | |
|---|---|---|
| WO | 2006/039719 | 4/2006 |
| WO | 2006/075181 | 7/2006 |
| WO | 2008/015387 | 2/2008 |
| WO | 2009/082234 | 7/2009 |

OTHER PUBLICATIONS

G. Houot, et al, "Operations Carried Out on a Subsea Wellhead in a Water depth of Approximately 210 Feet," SPE of AIME, 1974, paper SPE 4827.

D.G. Clarke, et al, "Low-Cost Wireline and Logging Operations on a Satellite Well Using a Subsea Wireline Lubricator Deployed From a Dynamically Positioned Monohull Vessel," Offshore Technology Conference, OTC 5726, May 1988.

P.K. Munkerud, et al, "Reserless Light Well Intervention (RLWI)," Offshore Technology Conference, OTC 18746, May 2007.

* cited by examiner

SUBSEA WELL INTERVENTION LUBRICATOR AND METHOD FOR SUBSEA PUMPING

CROSS-REFERENCE TO RELATED APPLICATION

The present document is based on and claims priority to U.S. Provisional Application Ser. No. 61/136,219, filed Aug. 19, 2008.

TECHNICAL FIELD

The present invention is directed to a system and a method of pressure pumping, flushing and chemical injection of a subsea well intervention lubricator (also referred to herein as a "well intervention lubricator" or "subsea lubricator"). The method and system utilizes underwater pumps and fluid storage reservoirs in contrast to the heretofore existing approach which uses surface equipment, such as pumps, flushing and injections of chemical(s), and hydraulic down-lines, connecting the surface to the subsea lubricator.

BACKGROUND

Conventional well intervention lubricators, installed on top of subsea Christmas trees, are well known and regularly utilized during operations for "Riser-less Work-overs" or "Light Well Interventions". The specific purpose of such well intervention lubricators, is to allow a downhole tool deployed from either a wireline, slickline or coiled tubing conveyance member to be lowered into the subsea well, while initially under pressure equalization with the ambient underwater hydrostatic pressure, and then subsequently under pressure equalization with the high pressure well bore fluid.

A well intervention lubricator usually includes a section of a vertical riser pipe with pressure seals and valves at each end. By opening and closing the seals and valves, the pressure inside the lubricator can be adjusted to equalize either with the ambient seawater (to allow the downhole tools to be loaded) or the well bore fluid (to allow the downhole tools to be lowered into the well bore). The lubricator is therefore a kind of pressure "lock-out" chamber. By means of the uppermost pressure retaining seal on the lubricator (which allows the capture and penetration of a conveyance member) having (i.e., being made of) a dynamic nature and permitting the relative movement of the conveyance member, it is then possible to lower the downhole tool into the well to undertake various well operations that may be desired. However, an inevitable side effect of such activities, including the use of such lubricator, is that that the subsea lubricator is likely to become either partially or fully contaminated with well bore fluid.

Examples of such operational experiences are well known, e.g., see the following publications, all incorporated herein by reference:

1. Houot, G., and Issarte, J. P., "Operations Carried Out on a Subsea Wellhead in a Water depth of Approximately 210 Feet", Society of Petroleum Engineers of AIME, Paper SPE 4827;
2. Clarke, D. G. and Warne, A. S., "Low-Cost Wireline and Logging Operations on a Satellite Well Using a Subsea Wireline Lubricator Deployed From a Dynamically Positioned Monohull Vessel", Offshore Technology Conference, OTC 5726, May 1988; and 3. Munkerud, P. K., Inderberg, O., "Riserless Light Well Intervention (RLWI)", Offshore Technology Conference, OTC 18746, May 2007.

The operational examples referenced above, and heretofore known, are limited to the use of lubricators placed in water depths up to approximately 300 m (1,000 ft); that is, operations have to date been restricted to relatively shallow water. In contrast subsea Christmas trees have recently been installed in much deeper water, up to and exceeding 2,000 m (6,600 ft) water depth.

PCT Application No. WO 2009/082234 by FMC KONGSBERG SUBSEA discloses a method and system for circulating fluid in a deepwater subsea intervention stack.

During well intervention subsea lubricator operations there are several pumping activities that are usually required, namely;

- pressure integrity testing of the lubricator assembly once it has been installed on top of the well Christmas tree and prior to equalization with well bore pressure conditions;
- cleaning out the lubricator following downhole operations by flushing out with a mixture of seawater and chemical additives; and
- injection of chemical additives may also be required on some occasions during downhole operations.

Such pumping operations have until now been performed only from the decks of the support ships or platforms using surface pumps, fluid reservoirs, hydraulic down-lines and return lines. See Houot et al., Clarke et al. and Munkerud et al. for more detail. However the use of such hydraulic down-lines and return lines often creates difficulty, e.g., such lines are large, expensive and quite troublesome to handle even at the relatively shallow water depths described above. One of the main reasons for such difficulties is that the length of these hydraulic lines in conjunction with the desire to retain an economically small diameter thereof results in relatively large frictional losses in the lines during pumping. This leads to inefficiency of the operation. It is expected that these difficulties discussed above for the surface pumps, fluid reservoir, hydraulic down-line and return line apparatus and methods will only be exacerbated in deep water.

Furthermore, the subsea pumping system claimed and described herein is preferably capable of operating under various pressures and flows as required by the specific well profiles and ambient pressure conditions. As such, a variable displacement and variable pressure pumping system should be employed to meet these requirements. Pumps, capable of operating on chemicals used for well operations are currently not available in variable displacement designs. Current art has these pumps connected to variable speed motors. For application in a subsea environment with fixed speed motors, these pumps will not provide the required flow and pressure regulation required for well flushing operations. Alternatively, a hydraulic motor can be attached to these current pumps to provide variable displacement but at the expense of reduced efficiency. Further additional electric motors would be required to provide a power source for these pumps, driving the umbilical to a greater diameter by higher power demand.

SUMMARY OF INVENTION

Therefore, there is a need for a system and method (which also may be referred to herein as an "apparatus") that addresses discovered problems with existing systems and methods using subsea well intervention lubricators on the seabed in the context of underwater hydrocarbons production facility. The above and other needs and problems are addressed by the present invention, exemplary embodiments of which are presented in connection with the associated figure.

In a first aspect of the present invention, a subsea well service system is provided comprising a well intervention lubricator, which is placed at a subsea location. The system further comprises at least one pump provided at a subsea location proximate the well intervention lubricator, wherein the pump is operatively connected to the well intervention lubricator. The system also comprise one or more fluid reservoir(s), placed at a subsea location, operatively connected to the at least one pump.

In an exemplary embodiment of the first aspect, the well intervention lubricator is operatively connected to and attached to a Christmas tree of an underwater hydrocarbons production facility. In another exemplary embodiment of the first aspect, the subsea well service system further comprises a returns storage reservoir. The returns storage reservoir may be operatively connected to the well intervention lubricator and placed at a subsea location in proximity to the well intervention lubricator.

In another exemplary embodiment of the first aspect, the well intervention lubricator comprises means for controlling the at least one pump, and said means may be shared with a means for controlling the well intervention lubricator. The subsea well service system may further comprise a hydraulic power unit for providing hydraulic power to the well intervention lubricator. The hydraulic power unit may also provide power to the at least one pump.

In a second aspect of the present invention, a method for flushing a well intervention lubricator is provided. The method commences after at least one downhole tool has been introduced into a subsea well of an underwater hydrocarbons production facility, wherein the underwater hydrocarbons production facility includes a subsea pump operatively connected to the well intervention lubricator, and a first and second fluid reservoir. The method preferably comprises the steps of pumping a fluid from the first fluid reservoir into the well intervention lubricator by means of the pump located subsea. The method further comprises displacing at least a portion of the fluid from the well intervention lubricator into the second fluid reservoir.

In an exemplary embodiment of the second aspect, the method further comprises the step of pumping the fluid stored in the second fluid reservoir to the well, to the flowline, or to the sea. In another exemplary embodiment of the second aspect, the fluid may comprise hydrate inhibitor, sea water, and/or well compatible fluids. In yet another exemplary embodiment of the second aspect, the fluid in the first fluid reservoir may comprise sea water mixed with hydrate inhibitor initially contained in the well intervention lubricator after removal of the downhole tool.

Still other aspects, features, and advantages of the present invention are readily apparent from the entire description thereof, including the figures, which illustrate a number of exemplary embodiments and implementations. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

Various aspects and embodiments of the present invention are described below in the appended drawings to assist those of ordinary skill in the relevant art in making and using the subject matter hereof. In reference to the appended drawings, which are not intended to be drawn to scale, like reference numerals are intended to refer to identical or similar elements. For purposes of clarity, not every component may be labeled in every drawing.

DETAILED DESCRIPTION

All singular forms of any components or apparatus described herein are understood to include plural forms thereof and vice versa. As such, examples of specific implementations are provided herein for illustrative purposes only and are not intended to be limiting. In particular, acts, elements and features discussed in connection with one embodiment are not intended to be excluded from a similar role in other embodiments. Also, the phraseology and terminology used herein is for the purpose of description and should not be regarded as limiting. The use of "including," "comprising," "consisting of," "having," "containing," "involving," and variations thereof herein, is meant to be broad and to encompass the items listed thereafter and equivalents thereof as well as additional subject matter not recited.

The present invention is directed to a method and apparatus (also referred to herein as a "system") for performing pumping and flushing of a well intervention lubricator by the use of underwater pumps. The pumps are either plumbed (or installed) directly onto the subsea lubricator itself or connected via short hose lines (known as "jumpers"). Such a method and apparatus is advantageous insofar as it replaces surface pumps and hydraulic down-lines with underwater equipment. A specific advantage is that the hydraulic down-line length is greatly reduced (or removed entirely) and thus the inefficiency resulting from the friction loss during pumping is dramatically ameliorated or reduced. Thus, the flow rate of the fluids pumped into the well intervention lubricator can be significantly increased. The economics of the overall system are therefore improved relative to heretofore known well intervention lubricators. Furthermore the economic advantage is likely to increase with increasing water depth.

Advantageously, in this method and system a fluid reservoir or reservoirs, which contain(s) the chemicals required for the operation of the method and apparatus of this invention, is placed underwater and in close proximity to the pump. The fluid reservoir may be replenished either by lowering it in a vessel as a batch from the surface support ship or platform, or alternatively by keeping the reservoir underwater and continuously or semi-continuously supplying fluid (i.e., chemicals) into the fluid reservoir through a down-line or remotely operated vehicle (ROV) skid. An advantage of either of these approaches, compared with the heretofore commonly-used surface pump and down-line methods and apparatus, is that the underwater fluid reservoir does not necessarily have to be replenished at the high pressure or flow rate needed during the heretofore-required surface-based pumping operations. If chemicals are not required (e.g. in specific cases where seawater alone is adequate) then no fluid reservoir is required as ambient water can be used.

Figure 1:
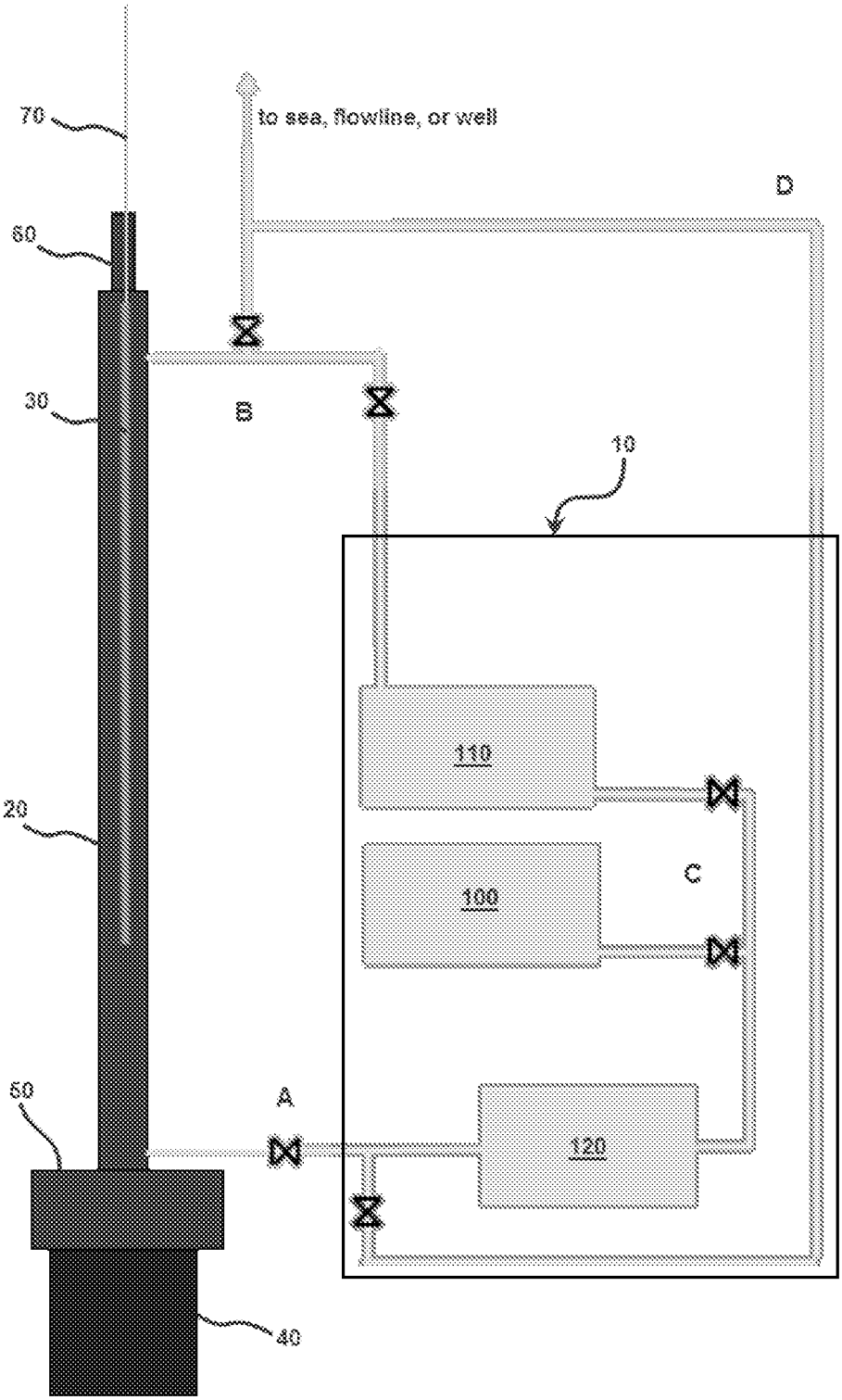
FIG. 1 depicts a schematic illustration of a subsea intervention system according to an exemplary embodiment of the present invention.

A further enhancement within the scope of the present invention is the replacement of the hydraulic return line(s) to the vessel with an underwater returns storage reservoir. This enhancement is advantageous compared with the existing surface pump and return-line method(s) and apparatus in that the sizing of any returns line to be used in conjunction with an underwater returns storage reservoir would provide similar economic advantages to those described for down-line sizing (and possibly removing the returns line requirement altogether in cases where the fluid returns reservoir could be recovered to the surface as a batch load). FIG. 1 is a sketch illustrating the main components of the present invention.

An even further enhancement within the scope of the present invention teaches a method and system for making the underwater pumping system simpler, more economical and easier to deploy. In accordance with such embodiment, the underwater pumping system may share the electrical and/or hydraulic power of the control system deployed to either control the lubricator package and/or any other underwater pumping systems in the proximity of the fluid reservoir. The underwater pumping system may also be driven by the same power unit as the underwater hydraulic power unit providing hydraulic power to the lubricator package control system. In addition the underwater pumping system may either be controlled by the lubricator package control system or may control the lubricator package control system using its control system.

As described above, lubricator subsea flushing is currently performed in the prior art by pumping fluid from a surface reservoir into the conduit of an umbilical in the water column then into the lubricator package bore, and fluids are returned from the lubricator bore into another conduit of the umbilical to the vessel.

According to an exemplary embodiment presented herein, the flushing method of the present invention can be performed and enabled by the subsea pumping system with the following advantages (which are illustrative only and are not intended to be limiting):

- does not require any conduits in the water columns;
- can significantly reduce the volume of hydrate inhibitor used to displace the lubricator package bore fluids; and
- can significantly reduce the volume of hydrate inhibitor pumped into the well or to the sea.

The following additional references are directed to subsea well intervention lubricators or other aspects of offshore hydrocarbon exploration, and are incorporated herein by reference in their entireties: PCT Application WO 2006/003362 A1; PCT Application WO 2006/0039719 A2; PCT Application WO 2008/015387 A1; PCT Application WO 02/084160 A1; and U.S. Pat. No. 6,539,778.

In an exemplary embodiment of the present invention, the subsea pumping system eliminates the heretofore mentioned and disclosed shortfalls with existing systems and methods. The subsea pumping system 10 taught herein, and depicted in FIG. 1, preferably comprise at least one pump 120 provided at a location proximate to the well intervention lubricator 20, wherein the at least one pump 120 is operatively connected to the well intervention lubricator 20; and at least one fluid reservoir 100/110 provided at a subsea location proximate the well intervention lubricator 20, wherein the at least one fluid reservoir 100/110 is operatively connected to the at least one pump 120.

The pumps presented herein are preferably subsea intensifiers, which can be used to boost pressures in a water or hydraulic system using a fixed area ratio. Intensifiers can also be controlled by varying the input pressure and flow to provide a varying output pressure and flow depending on the ratio of intensification. This design can be provided without the requirement to add a power consuming hydraulic motor.

The power input to the intensifier is by flow and pressure from a hydraulic power source. In an exemplary embodiment of the system, a variable displacement, variable pressure, hydraulic pump is installed on the secondary output shaft of the motor powering the main intervention subsea hydraulic system. The hydraulic pump output pressure and flow powering the intensifier can be controlled by the intervention system controls. The intensifier variable output flow may be controlled by the hydraulic pumps or by throttle valves located on the output of the intensifier(s).

In an alternative arrangement, the pumping system 10 may use the same hydraulic fluid as the primary hydraulic system; however, it is preferable to use a separate flow circuit with its own reservoir, as on ROV's.

To prevent constant high power draw, the pump powering the intensifier can be commanded to the low pressure, no flow standby condition by the controls when not in use during operations. When required, the pump can be commanded to provide the flow and pressure required to operate the chemical injection intensifiers providing the correct amount of fluid and pressure needed for chemical injection. The pump controls can be designed to give demand priority to the main hydraulic pump operating the intervention system to prevent loss in operating pressure required for that system.

Figure 2:
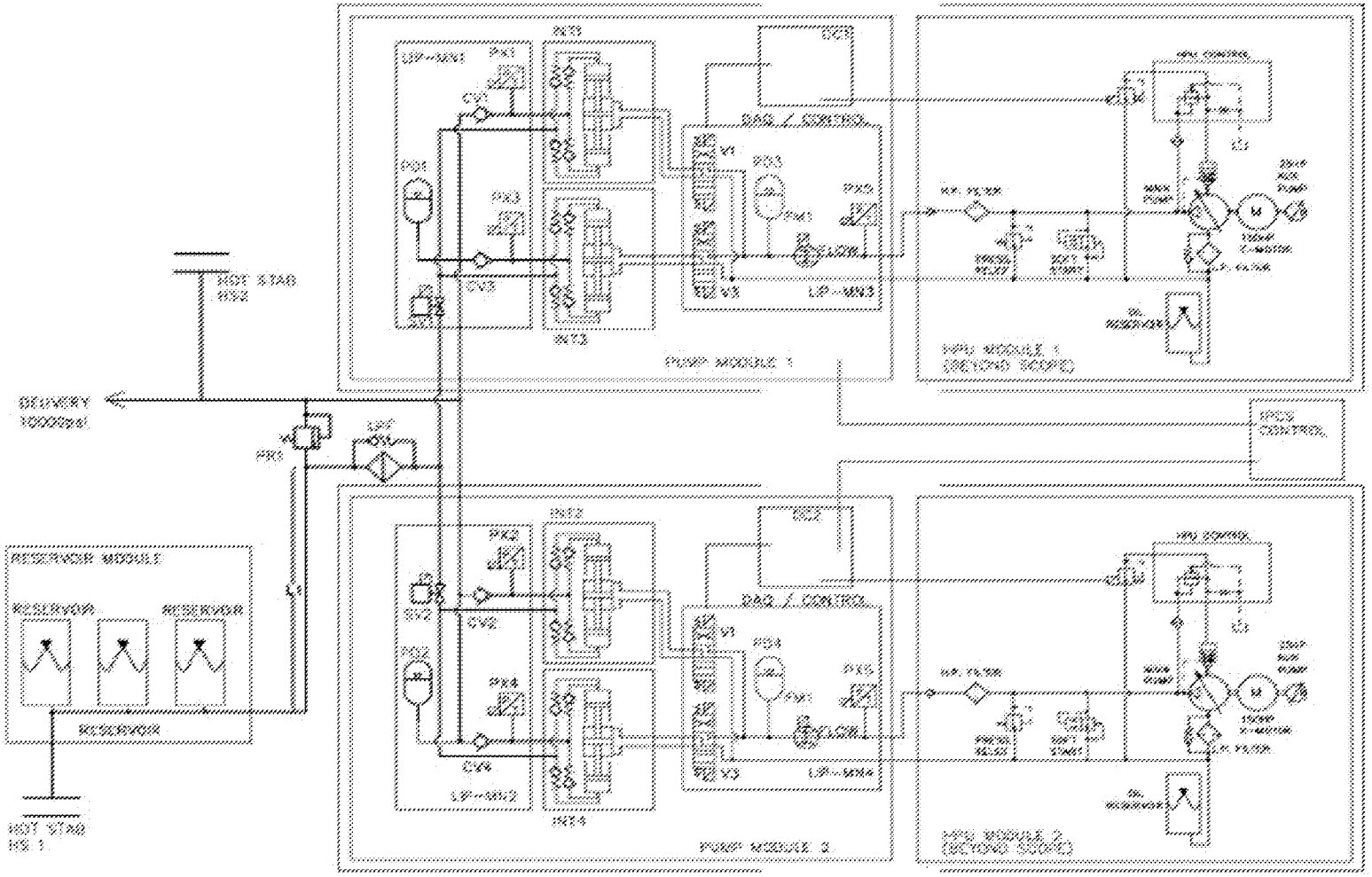
FIG. 2 depicts a schematic illustration of a subsea pump system according to an exemplary embodiment of the present invention.

Referring now to FIG. 2, additional components may be required to operate the system as shown in the schematic. Such components include, but are not limited to, pulsation dampeners, boost pumps, filters, throttle valves, etc. The chemicals that can be pumped with this system include Mono Ethyl Glycol (MEG), Methanol, seawater and various mixtures of MEG and water. These chemicals can be mixed subsea by using the presently described system, and can be premixed at the surface or mixed using a down-line, ROV skid and/or trip reservoirs. A down-line can be used for system reservoir recharge or to top-up the storage reservoirs as required. This system may also receive MEG or Methanol from the production system for top-up or directly to the pumping system 10.

In an exemplary embodiment, the pumping system 10 does not require compensation to the lubricator 20 via a separate pressurized reservoir. Rather the pumping system 10 preferably has sufficient motive power to pump against the internal pressure inside the lubricator 20 within the flow ranges required to flush and pressure test the lubricator 20 during all operations.

A separate ROV skid, with a MEG or Methanol reservoir and high pressure pump, may also be used to connect directly into the pumping system 10 high pressure line supplying fluid to the lubricator 20. Because the separate ROV skid is used primarily when hydrates form, Methanol for hydrate remediation can be delivered, when needed, by a skid mounted on the ROV. The skid will be complete with an intensifier (operable from the ROV hydraulic supply and by ROV controls) and skid fluid storage.

Referring now to FIG. 1, an exemplary method and system is depicted for flushing the subsea lubricator package 20 after lubricating a toolstring 30 out of the well and before opening the lubricator 20 to the sea. Well intervention toolstring change out may require the operator to open the top of the lubricator 20 to the sea if no riser or conduit is connected to the top of the lubricator 20, or if there is a conduit that the toolstring cannot pass through.

After lubricating a toolstring 30 out of the well and closing the lower valve 50, or blowout preventer (BOP), connected to the subsea tree 40 of the lubricator package 20, the fluid in the lubricator package bore 20 consists of a mixture of well bore fluids, hydrate inhibitor, and/or well compatible fluids which need to be disposed before opening the lubricator 20 to the sea.

At least two new flushing methods are presented herein, and are preferably performed with an exemplary embodiment of the subsea pumping system (i.e. they do not require any conduits in the water columns, they significantly reduce the volume of hydrate inhibitor used to displace the lubricator package bore fluids, and they also reduce the volume of hydrate inhibitor pumped into the well).

Method # A-1

As shown in FIG. 1, the underwater pump(s) 120 are preferably adapted to pump hydrate inhibitor, sea water, or well compatible fluid from the underwater reservoir #1 (100) and the piping system "C" into the piping system "A", then into the lubricator package bore 20 and displace the fluid of the lubricator bore 20 into the piping system "B", then into the underwater reservoir #2 (110). At a minimum, the volume of the lubricator bore 20 between the piping system "A" and piping system "B" is displaced to the underwater reservoir #2 (110).

At this stage, the lubricator package bore 20 is full of the fluid that was in the underwater reservoir #2 (110) or the underwater reservoir #1 (100) with residual hydrocarbons that have not been displaced by the first flushing. It should be understood that further flushing can be performed in a similar manner to reduce or eliminate the residual hydrocarbons before opening the lubricator 20 to the sea.

Hydrocarbons and/or well compatible fluids and/or hydrate inhibitor are now contained in the underwater reservoir #2 (110). The liquid phase of the fluid stored in underwater reservoir #2 (110) may then be pumped to the well or flowline with the subsea pump(s) 120 pumping from the underwater reservoir #2 (110) and piping system "C" into the piping system "D", and then into the well or flowline. The reservoir can be recovered to surface with a lift wire.

Method # A-2

In another exemplary flushing method for displacing the lubricator package bore fluids (also shown with reference to FIG. 1), the underwater pump(s) 120 are adapted to pump hydrate inhibitor, sea water, or well compatible fluid from the underwater reservoir #2 (110) and the piping system "C" into the piping system "A", then into the lubricator package bore 20 and displace the fluid of the lubricator bore 20 into the piping system "B", then to the well or to the flowline. The volume first displaced into the well or to the flowline can be a fraction of or the totality of the lubricator package bore volume between the piping systems "A" and "B".

This first flushing function preferably pumps all the gas and/or part of or all of the liquid fluid that is in the lubricator package bore 20 into the well or flowline.

In addition, the underwater pump(s) 120 can pump hydrate inhibitor and/or well compatible fluid from the underwater reservoir #1 (100) and the piping system "C" into the piping system "A", then into the lubricator package bore 20 and displace the fluid of the lubricator bore 20 into the piping system "B", then to the underwater reservoir #2 (110). The fluid displaced to the underwater reservoir #2 (110) is likely a liquid fluid that is a mixture of well compatible fluid, hydrate inhibitor, and/or residual hydrocarbons. This fluid can be re-used in the next flushing cycle, if necessary, after the toolstring 30 is pulled back into the lubricator 20 and before the lubricator 20 is opened to the sea as described above.

Referring again to FIG. 1, an exemplary method and system is depicted to avoid flushing the subsea lubricator package 20 after a toolstring change out with the lubricator 20 opened to the sea.

During well intervention toolstring change out, which comprises opening the top of the lubricator 20 to the sea, where the toolstring 30 can be pulled out of the lubricator 20 with the top of the lubricator 20 opened to the sea. While the toolstring 30 is being pulled out, a volume of sea water corresponding to the volume of the toolstring 30 pulled out enters into the lubricator 20. When a new toolstring 30 is deployed into the lubricator 20 a volume of fluid in the lubricator 20 corresponding the new toolstring volume over-flows from the lubricator 20. At the end of the toolstring 30 deployment after the lubricator 20 is closed and a dynamic seal 60 at the top has been activated and sealed around the conveyance 70 (cable or coiled tubing), the fluid in the lubricator 20 is a mix of sea water and hydrate inhibitor of various concentrations as sea water mixes with the hydrate inhibitor initially disposed in the lubricator bore 20.

To ensure that there is a homogeneous fluid in the lubricator package bore 20 with the required hydrate inhibitor concentration, the prior art flushing method requires to pump hydrate inhibitor or well compatible fluids from the vessel into a conduit in the water column then into the lubricator package bore 20 then into a return conduit back to the vessel.

At least two new flushing methods are described herein, and are preferably performed with an exemplary embodiment of the subsea pumping system 10 (i.e. they do not require any conduits in the water columns, and significantly reduces the volume of hydrate inhibitor used or released to the sea).

Method # B-1

As shown in FIG. 1, the underwater pump(s) 120 are preferably adapted to pump hydrate inhibitor from the underwater reservoir #1 (100) or the underwater reservoir #2 (110) through the piping system "C" into the piping system "A" then into the lubricator package bore 20 and displace the fluid of the lubricator bore 20 into the piping system "B", then back to the same underwater reservoir.

The volume circulated within the loop likely depends on the volume of water that has entered into the lubricator bore 20, which can be a fraction of the total volume, or one full cycle or more.

This closed loop circulation system mixes the sea water, and the hydrate inhibitor of various concentrations with fluid at a higher concentration of hydrate inhibitor that is in the underwater reservoir; therefore, ensuring that the fluid in the lubricator bore 20 has a homogeneous and the minimum required concentration of hydrate inhibitor.

Method # B-2

In another exemplary embodiment, a second method can first flush to the sea part of the lubricator package volume, then implementing the above Method #B-1.

Again shown in FIG. 1, the underwater pump(s) 120 adapted to pump hydrate inhibitor from the underwater reservoir #1 (100) or the underwater reservoir #2 (110) through the piping system "C" into the piping system "A", then into the lubricator package bore 20, and displace the fluid of the lubricator bore 20 into the piping system "B" to the sea.

The volume of fluid displaced to the sea may depend on the volume of the water that enters the lubricator 20 (i.e. the volume of the toolstring 30 pulled out, and/or the volume of the toolstring 30 deployed which can create an overflow from the lubricator 20).

The underwater pump(s) 120 may subsequently pump hydrate inhibitor from the underwater reservoir #1 (100) or the underwater reservoir #2 (110) through the piping system "C" into the piping system "A", then into the lubricator package bore 20, and displace the fluid of the lubricator bore 20 into the piping system "B" back to the same underwater reservoir.

This closed loop circulation mixes the sea water that was not flushed to the sea during the first step, the hydrate inhibitor of various concentrations with fluid at a higher concentration of hydrate inhibitor that is in the underwater reservoir to ensure that the fluid in the lubricator bore 20 has a homogeneous and the minimum required concentration of hydrate inhibitor.

Having now described some illustrative embodiments of the present invention, it should be apparent to those skilled in the art that the foregoing is merely illustrative and not limiting, having been presented by way of example for the purposes of clarity. Numerous modifications and other embodiments are within the scope of one of ordinary skill in the art and are contemplated as falling within the scope of the present invention. In particular, although many of the examples presented herein involve specific combinations of method acts or system elements, it should be understood that those acts and those elements may be combined in other ways to accomplish the same objectives.

Further, those skilled in the art should appreciate that the parameters and configurations described herein are exemplary and that actual parameters and/or configurations will depend on the specific application in which the systems and techniques of the present invention are used. Those skilled in the art should also recognize or be able to ascertain, using no more than routine experimentation, equivalents to the specific embodiments of the present invention. It is therefore to be understood that the embodiments described herein are presented by way of example only and that, within the scope of the appended claims and equivalents thereto; the present invention may be practiced otherwise than as specifically described.

Moreover, it should also be appreciated that the present invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the present invention as embodied in the claims. Further, acts, elements, and features discussed only in connection with one embodiment are not intended to be excluded from a similar role in other embodiments. Rather, the systems and methods of the present disclosure are susceptible to various modifications, variations and/or enhancements without departing from the spirit or scope of the present disclosure. Accordingly, the present disclosure expressly encompasses all such modifications, variations and enhancements within its scope.

What is claimed is:

1. A subsea well service system comprising:

a well intervention lubricator exposeable to ambient subsea hydrostatic pressure;

at least one pump provided at a location proximate to the well intervention lubricator, the at least one pump being operatively connected to the well intervention lubricator; and at least one fluid reservoir provided at a subsea location proximate the well intervention lubricator, the at least one fluid reservoir being operatively connected to the at least one pump.

2. The subsea well service system of claim 1, wherein the well intervention lubricator is operatively connected to and attached to a Christmas tree of an underwater hydrocarbons production facility.

3. The subsea well service system of claim 1, further comprising a returns storage reservoir.

4. The subsea well service system of claim 3, wherein the returns storage reservoir is operatively connected to the well intervention lubricator and placed at a subsea location in proximity to the well intervention lubricator.

5. The subsea well service system of claim 1, further comprising an integrated pump control system adapted to control the at least one pump.

6. The subsea well service system of claim 5, wherein the integrated pump control system adapted to control the at least one pump is shared with a means for controlling the well intervention lubricator.

7. The subsea well service system of claim 1, further comprising a hydraulic power unit for providing hydraulic power to the well intervention lubricator.

8. The subsea well service system of claim 7, wherein the hydraulic power unit provides power to the at least one pump.

9. A method for flushing a well intervention lubricator exposable to ambient subsea hydrostatic pressure, after at least one downhole tool has been introduced into a subsea well of an underwater hydrocarbons production facility, wherein the underwater hydrocarbons production facility includes a subsea pump operatively connected to the well intervention lubricator and a first and second fluid reservoir, the method comprising:

pumping a fluid from the first fluid reservoir into the well intervention lubricator by means of the pump located subsea; and displacing at least a portion of the fluid from the well intervention lubricator into the second fluid reservoir.

10. The method of claim 9, further comprising pumping the fluid stored in the second fluid reservoir to the well, to the flowline, or to the sea.

11. The method of claim 9, wherein the fluid is selected from the group consisting of: hydrate inhibitor, sea water and well compatible fluids.

12. The method of claim 9, wherein the fluid in the first fluid reservoir comprises sea water mixed with hydrate inhibitor initially contained in the well intervention lubricator after removal of the downhole tool.

* * * * *